United States Patent [19]

Nelson

[11] Patent Number: 4,679,408

[45] Date of Patent: Jul. 14, 1987

[54] DISPENSING AND COOLING APPARATUS

[76] Inventor: James L. Nelson, P.O. Box 821, Gold Coast, Queensland, Australia, 4220

[21] Appl. No.: 828,426

[22] Filed: Feb. 11, 1986

[51] Int. Cl.[4] ..... B67D 5/62

[52] U.S. Cl. ..... 62/390; 62/393; 62/396; 222/146.6

[58] Field of Search ..... 62/390, 393, 394, 396, 62/399, 389, 435; 222/146.6

[56] References Cited

U.S. PATENT DOCUMENTS

| | | | |
|---|---|---|---|
| Re. 20,981 | 1/1939 | Riesgo | 62/390 |
| 2,078,026 | 4/1937 | Sandell | 62/396 X |
| 2,140,816 | 12/1938 | Seitz | 62/390 X |
| 2,253,940 | 8/1941 | Peet | 62/390 X |
| 2,728,207 | 12/1955 | Tunt | 62/390 |
| 3,058,620 | 10/1962 | Kromer | 62/390 X |
| 4,332,145 | 6/1982 | Yahasz et al. | 62/435 X |

*Primary Examiner*—William E. Tapolcai
*Attorney, Agent, or Firm*—Townsend and Townsend

[57] ABSTRACT

A cooling apparatus for cooling a beverage having a primary cooling means located between an inlet and an outlet of a beverage dispensing apparatus. The primary cooling means has a cooling assembly comprising an expansion chamber into which refrigerant can be introduced and flow paths through the chamber for the beverage. One flow path forms part of a secondary cooling means. The secondary cooling means is located in heat exchange relationship with the beverage. The secondary cooling means includes refrigerant circulating means having a supply line coupled to one end of the one flow path. A heat exchanger is located in heat exchange relationship with the beverage and is located in the outlet.

11 Claims, 4 Drawing Figures

DISPENSING AND COOLING APPARATUS

The invention relates to improvements in and relating to cooling apparatus for a beverage and to a dispensing apparatus in combination with a cooling apparatus.

Most dispensing apparatus for cold beverages store the beverage at room temperature and provide heat exchange means interposed between the beverage container and the dispensing tap to chill the beverage as it is dispensed. A typical system used in the liquor trade is that sold under the trade mark TEMPRITE which utilizes an expansion chamber for refrigerant and in which a pair of coils are disposed, through which beverage such as beer may flow from a keg to a respective tap. The expansion chamber forms part of a refrigeration cycle in which compressed refrigerant expands to chill the coils and the beverage flowing therethrough.

A disadvantage with such systems is that during periods of high beverage demand the capacity of the refrigeration cycle may be exceeded with the result that the beverage will not be chilled to the desired degree.

In a latter machine, commonly known as an ice bank machine, this disadvantage has been overcome by locating the coil or coils through which the beverage passes in a reservoir of ice maintained substantially frozen by suitable refrigeration apparatus. In this type of machine the reservoir of ice builds up during periods of low demand for latter use during high demand periods whereby the beverages will be chilled even though the capacity of the refrigeration apparatus may be temporarily exceeded. However, since the beverage can only be cooled to about 1° C. its dispensed temperature may be too high.

A disadvantage associated with both types of dispensing apparatus is that the chilling coils are necessarily located some distance from the dispensing tap and thus during periods of low demand the temperature of the beverage located between the chilling coil and the tap will tend towards room temperature. This is a particular disadvantage if for example a tap is used to dispense a low demand beverage. In such instances the initial output from the tap may have to be discarded with the result that much of the beverage dispensed is wasted.

This invention aims to alleviate the above disadvantages and to provide a cooling apparatus and dispensing apparatus having a cooling apparatus which will be reliable and efficient in use. Other objects and advantages of this invention will hereinafter become apparent.

According to one aspect the invention provides cooling apparatus for cooling a beverage to be dispensed from a dispensing apparatus having an inlet for the beverage and an outlet means for dispensing the beverage, said cooling apparatus including:

primary cooling means locatable between the inlet and the outlet means and having a heat exchanger for cooling the beverage; and, secondary cooling means adapted to be located in heat exchange relationship with the beverage contained in the outlet means for ensuring that the temperature of the beverage contained in the outlet means does not fall below a desired value prior to dispensing the beverage from the outlet means.

The secondary cooling means is adapted to maintain the outlet means at or adjacent the desired dispensing temperature. The secondary cooling means may include a cooling reservoir for a coolant arranged in heat exchange relationship with the outlet apparatus. Preferable the cooling reservoir forms part of a closed flow circuit through which coolant circulates between said reservoir and a chilling station at which the coolant in said flow circuit is chilled to a desired degree. The secondary cooling means if desired may be part of the primary cooling means. Of course a separate cooling means or refrigeration apparatus could be used for the primary cooling means and secondary cooling means if desired. Furthermore the cooling reservoir could be an expansion chamber for a gas refrigeration cycle or it could be constituted by a low temperature plate of an electronic solid state cooling apparatus.

According to another aspect of the invention there is provided a dispensing apparatus for a beverage including:

an inlet for the beverage;

outlet means for dispensing the beverage; and, cooling apparatus having:

primary cooling means located between the inlet and the outlet means and having a heat exchanger for cooling the beverage; and, secondary cooling means located in heat exchange relationship with the beverage contained in the outlet means for ensuring that the temperature of the beverage contained in the outlet means does not fall below a desired value prior to dispensing the beverage from the outlet means.

The or each heat exchanger may be of any desired form, such as a coil passing around the supply inlet or supply line, or it may be a jacket forming a chamber for coolant about the supply inlet and/or valve means. Alternatively it may be a single coolant feeder line passing through a font or a coolant feeder line arranged in contact with the beverage feeder line.

The outlet means may include a valve which may be constituted by the usual valve associated with beer taps and thus comprise a cam operated handle which is attached to a spring loaded spindle biased towards a lower or closed position. Rotation of the handle causes the spindle to move upwardly towards an open or dispensing position.

In order that this invention may be more readily understood and put into practical effect, reference will now be made to the accompanying drawings which illustrate typical embodiments of the present invention, wherein.

Figure 1:
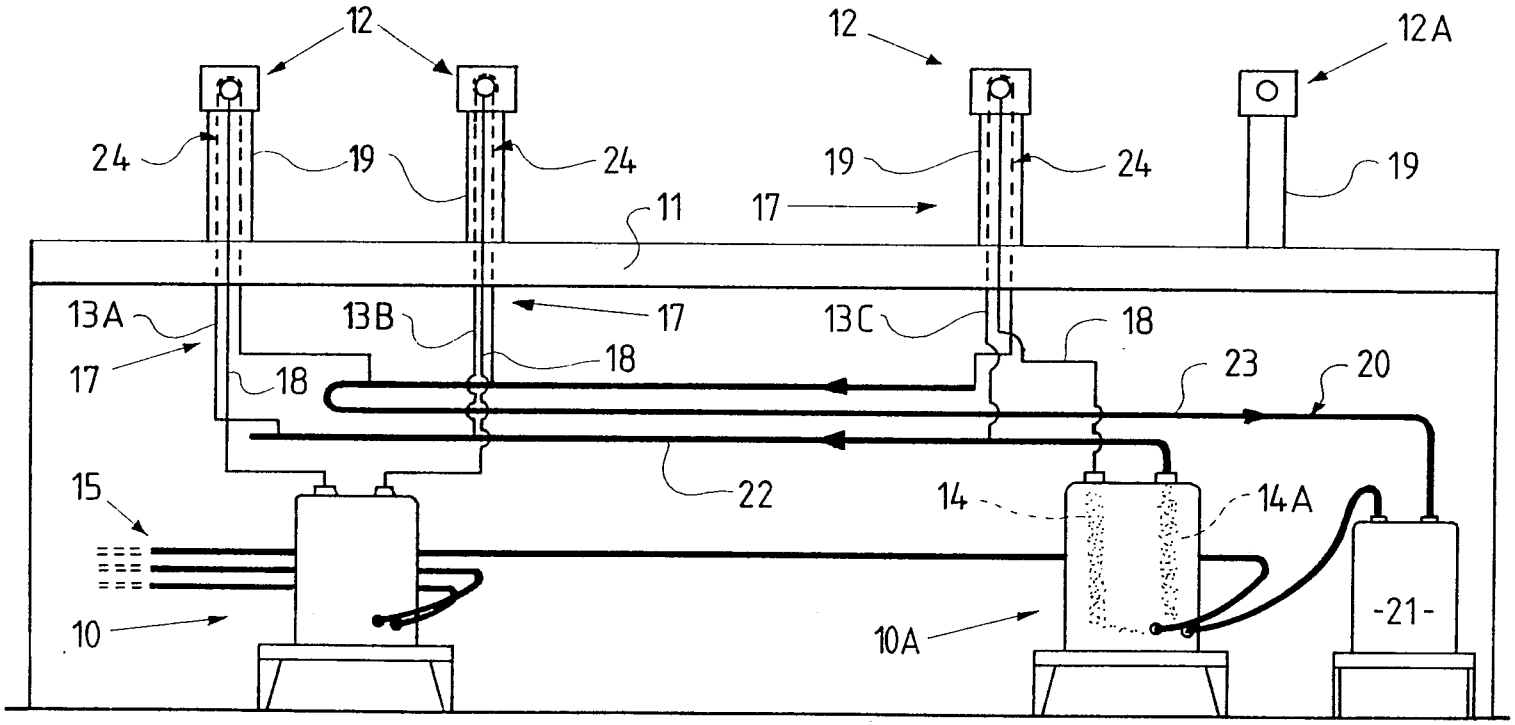
FIG. 1 is a flow diagram of a beverage dispensing apparatus in accordance with an embodiment of the present invention.

Referring initially to FIG. 1 it will be seen that a dispensing apparatus for beer includes two TEMPRITE beverage cooling assemblies 10 and 10A which may be installed under a counter 11 and each supplying a pair of taps 12 supported on fonts 19 mounted on the counter 11. Often in such installations one of the four taps 12 is not used or used infrequently and for the purpose of this embodiment of the present invention the cooling means associated with one tap 12A is disconnected and utilized in a secondary cooling circuit associated with the remaining taps 12.

Figure 2:
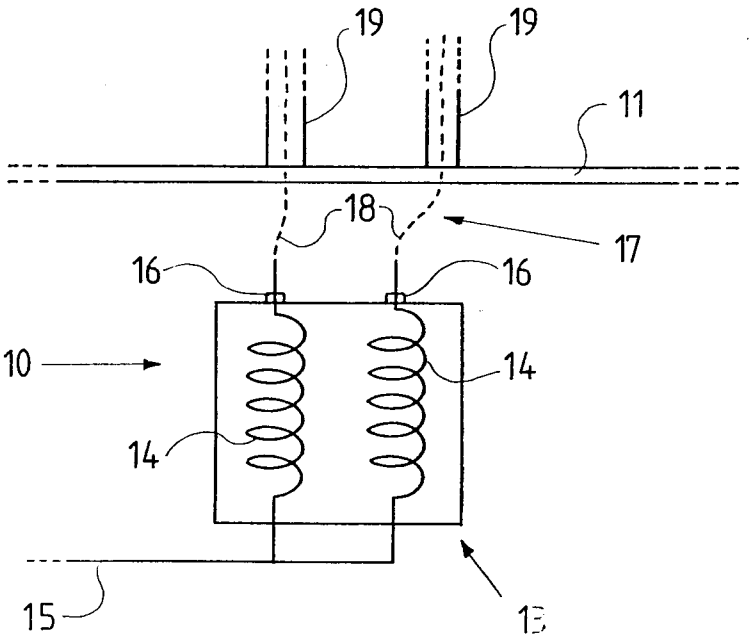
FIG. 2 is a diagrammatic view of a typical TEMPRITE assembly.

As can be seen in FIG. 2, each TEMPRITE assembly 10 includes an expansion chamber 13 into which compressed refrigerant expands. The chamber 13 contains a pair of coils 14 and 14A each supplied with beer from a common beer line 15. The outlet ends 16 of the coils 14 and 14A are connected to respective outlet apparatus 17 each of which includes a beer riser line 18 passing to the font 19 supporting the tap 12.

In the embodiment illustrated in FIG. 1 the coil 14A normally associated with the unused tap 12A is connected into a coolant flow circuit 20 in which a coolant is circulated by a pump 21 through a main supply line 22, a common return line 23 and heat exchange means 24 associated with each outlet apparatus 17. Each heat exchange means 24 is connected between the main supply line 22 and the common return line 23 by connection lines 13A, 13B and 13C. The connection line 13A has the longest return line in order to balance the system so that all fonts 19 are maintained at approximately the same temperature. All lines may be insulated to minimise heat losses.

In FIG. 2 there is shown a typical TEMPRITE assembly 10. Beer flows into assembly 10 through inlet line 15, through coils 14 and then through riser lines 18.

Figure 3:
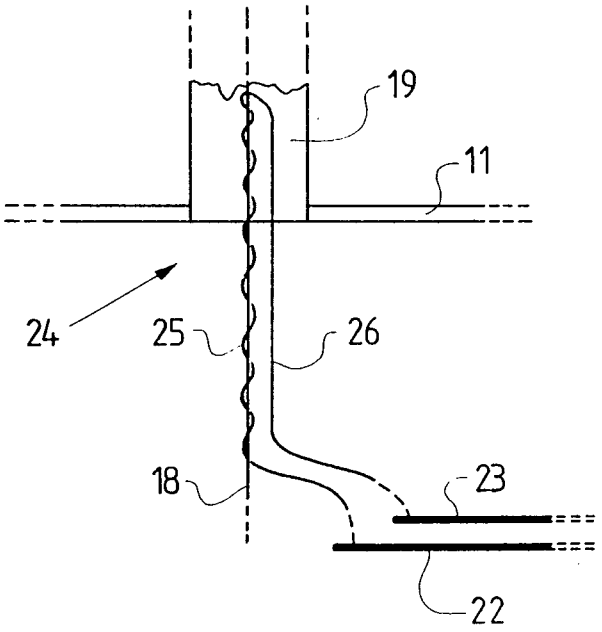
FIG. 3 illustrates a heat exchanger associated with an outlet means.

FIG. 3 shows in detail the connection between the supply and return lines 22,23 of FIG. 1 and the heat exchanger 24. As shown in FIG. 3 the connection lines in each heat exchanger 24 are coupled to a feed line 25 coiled about the respective riser line 18 and a return line 26. The pump 21 forces coolant from the return line 23 through the coil 14A to the supply line 22 to pass through the respective heat exchangers 24 associated with the three operative taps 12.

The coolant is suitably an anti-freeze agent such as brine or an organic solvent such as glycerine, glycol or alcohol.

In use, beer supplied to any one of the three operative taps 12 is chilled during passage through the respective coil 14 of the TEMPRITE apparatus. Provided each tap 12 is operated continuously cold beer will be dispensed. Should any of the taps be operated only on an infrequent basis, the small quantity of beer in the feeder line 18 thereto will be maintained at the appropriate temperature by the cooling effect provided by the recirculating coolant in the secondary circuit 20. Thus, the beer or other beverage dispensed from such infrequently used taps will be maintained at a suitable low temperature and all beverage direct from the tap will be at a suitable temperature for drinking. Accordingly, wastage of beverage will be minimised.

Figure 4:
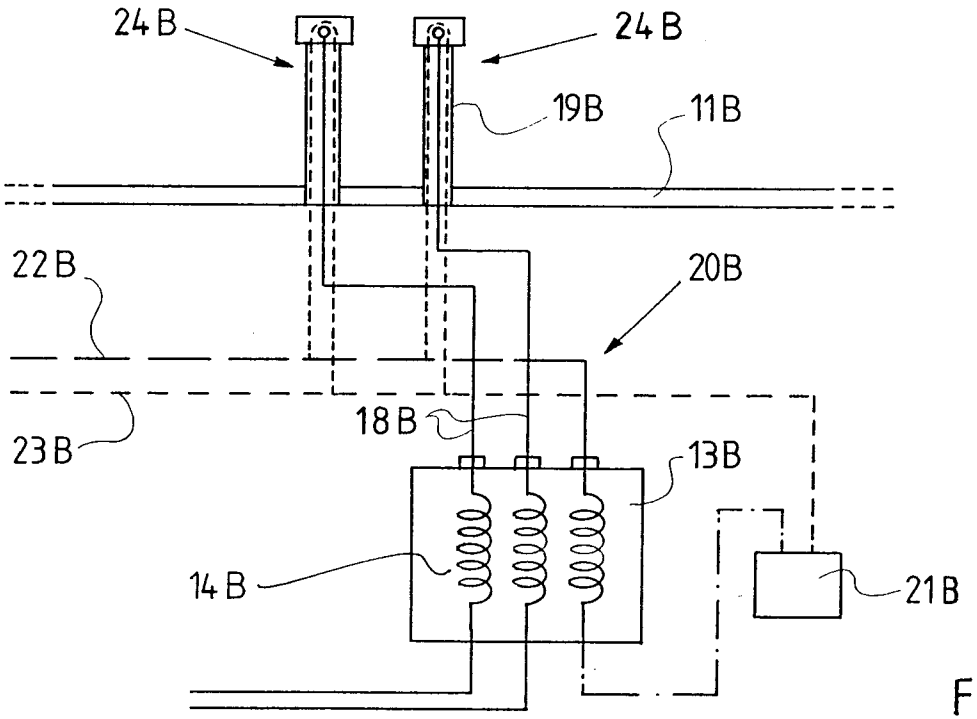
FIG. 4 is a diagrammatic view of a further embodiment of the invention.

A further embodiment of the invention is illustrated in FIG. 4. In this figure the expansion chamber 13B has three heat exchange coils 14B, two of which are connected into respective beer supply riser lines 18B to chill beer flowing therethrough while the third coil is incorporated into a secondary cooling means 20B including a supply line 22B and a return line 23B through which coolant is pumped by pump 21B to heat exchangers 24B associated with the respective fonts 19B. If desired, the secondary cooling means 20B could be arranged to circulate coolant through further heat exchangers associated with additional dispensing taps located on bench 11B or an adjacent bench (not shown). The primary cooling means for the beverage could be an ice bank machine or any other suitable form of chilling apparatus and if desired the coil utilized for chilling the coolant circulated through the secondary circuit could be located with the beverage chilling coils in the ice bank.

If desired cold water associated with the ice bank could be pumped for recirculation to heat exchange means associated with the dispensing outlet assembly. Alternatively, separate chilling apparatus could be used to cool the coolant.

What I claim is:

1. A cooling apparatus for cooling a beverage to be dispensed from a dispensing apparatus having an inlet for the beverage and outlet means for dispensing the beverage, said cooling apparatus including:

primary instantaneous cooling means locatable between the inlet and the outlet means and having a heat exchanger for cooling the beverage, said primary cooling means comprising at least one cooling assembly having an expansion chamber into which liquid refrigerant may be introduced and at least two flow paths through said chamber, a first said flow path being for the beverage and a second said flow path forming part of a secondary cooling means, said secondary cooling means being in heat exchange relationship with the beverage contained in the outlet means for ensuring that the temperature of the beverage contained in the outlet means is maintained at a desired value prior to dispensing the beverage from the outlet means, said secondary cooling means further including refrigerant circulating means having a supply line coupled to one end of said second flow path, a heat exchanger adapted to be located in heat exchange relationship with the beverage that may be contained in the outlet means and coupled to the other end of said second flow path and a return line between the heat exchanger of the secondary cooling means and the circulating means for returning refrigerant to the circulating means.

2. The cooling apparatus of claim 1 wherein said primary cooling means includes three flow paths, the first and second of said paths for cooling the beverage and directing it to respective said outlet means, said third path being coupled to said circulating means by said supply line and wherein said secondary cooling means includes a respective said heat exchanger in heat exchange relationship with respective said outlet means, said exchangers being fed with refrigerant by said third path and said return line adapted to return refrigerant from the exchangers to said circulating means.

3. The cooling apparatus of claim 1 wherein said primary cooling means includes two cooling assemblies, the first assembly having two flow paths, said flow paths adapted for directing the beverage through the chamber and to a respective said outlet means, the second assembly having first and second flow paths, said first flow path of the second assembly being adapted for directing the beverage through the chamber of the second assembly and to a respective said outlet means, said second flow path of said second assembly being coupled to the supply line and to respective said heat exchangers associated with said outlet means, the return line being coupled between the heat exchangers and the circulating means for returning the refrigerant to the circulating means.

4. The cooling apparatus of claim 1 wherein said heat exchangers are supplied in parallel with refrigerant from the third flow path or said second flow path of the second assembly.

5. The cooling apparatus of claims 1, 2 or 3 wherein the or each said heat exchanger comprises a coil for passing around a supply line of the outlet means or a respective said outlet means.

6. A dispensing apparatus for a beverage including:

an inlet for the beverage;

outlet means for dispensing the beverage; and cooling apparatus having:

primary instantaneous cooling means located between the inlet and the outlet means and having a heat exchanger for cooling the beverage, said primary cooling means comprising at least one cooling assembly having an expansion chamber into which liquid refrigerant may be introduced and at least first and second flow paths through the chamber for the beverage whereby beverage introduced to the inlet passes through the chamber for introduction to the outlet means, whereby said first flow path is for the beverage and said second flow path forms part of secondary cooling means which includes refrigerant circulating means having a supply line coupled to one end of said second flow path, a heat exchanger located in heat exchange relationship with the beverage contained in the outlet means and coupled to the other end of said second flow path and a return line between the heat exchanger of the secondary cooling means and the refrigerant circulating means.

7. The dispensing apparatus of claim 6 wherein said primary cooling means includes three flow paths, the first and second of said paths for cooling the beverage and directing it to a respective said outlet means, said third path being coupled to said circulating means by said supply line and wherein said secondary cooling means includes a respective said heat exchanger in heat exchange relationship with respective said outlet means, said exchangers being fed with refrigerant by said third path and said return line adapted to return refrigerant from the exchangers to said circulating means.

8. The dispensing apparatus of claim 6 wherein said primary cooling means includes two cooling assemblies, the first assembly having two flow paths, said flow paths adapted for directing the beverage through the chamber and to a respective said outlet means, the second assembly having first and second flow paths, said first flow path of the second assembly being adapted for directing the beverage through the chamber of the second assembly and to a respective said outlet means, said second flow path being coupled to the supply line and to respective said heat exchangers associated with said outlet means, the return line being coupled between the heat exchangers and the circulating means for returning the refrigerant to the circulating means.

9. The dispensing apparatus of claim 7 wherein said heat exchangers are supplied in parallel with refrigerant from the third flow path or said second flow path of the second assembly.

10. The dispensing apparatus of claim 6 wherein the or each said heat exchanger comprises a coil for passing around a supply line of the outlet means or a respective said outlet means.

11. The dispensing apparatus of claim 6 wherein the or each said outlet means includes a riser line communicating with a font and a valve or tap for controlling dispensing of the beverage.

* * * * *